US012752144B2

(12) United States Patent
Woo et al.

(10) Patent No.: US 12,752,144 B2
(45) Date of Patent: Oct. 6, 2026

(54) DRIVING DEVICE AND EXERCISE EQUIPMENT INCLUDING SAME

(71) Applicant: LG ELECTRONICS INC., Seoul (KR)

(72) Inventors: Se Young Woo, Seoul (KR); Jeong Uk Lee, Seoul (KR); Tae Hee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 41 days.

(21) Appl. No.: 18/838,424

(22) PCT Filed: Oct. 31, 2023

(86) PCT No.: PCT/KR2023/017091
§ 371 (c)(1),
(2) Date: Aug. 14, 2024

(87) PCT Pub. No.: WO2024/143838
PCT Pub. Date: Jul. 4, 2024

(65) Prior Publication Data

US 2025/0152991 A1 May 15, 2025

(30) Foreign Application Priority Data

Dec. 29, 2022 (KR) ..... 10-2022-0188543

(51) Int. Cl.
*A63B 21/005* (2006.01)
*A63B 21/00* (2006.01)
*A63B 24/00* (2006.01)

(52) U.S. Cl.
CPC ..... *A63B 21/0058* (2013.01); *A63B 21/153* (2013.01); *A63B 21/154* (2013.01);
(Continued)

(58) Field of Classification Search
CPC . A63B 21/0058; A63B 21/153; A63B 21/154; A63B 21/4033; A63B 24/0062;
(Continued)

(56) References Cited

U.S. PATENT DOCUMENTS 6,347,682 B1 2/2002 Buchner
7,579,742 B1 8/2009 Rittenhouse
(Continued)

FOREIGN PATENT DOCUMENTS

CN 101629619 1/2010
CN 103154546 6/2013
(Continued)

OTHER PUBLICATIONS

Extended European Search Report dated Jun. 30, 2025, issued in Application No. 23912525.5.
(Continued)

*Primary Examiner* — Andrew M Kobylarz
(74) *Attorney, Agent, or Firm* — KED & ASSOCIATES, LLP

(57) ABSTRACT

There is provided a driving device that provides an exercise load to the user to enable strength exercise, and exercise equipment including the same. A driving device according to one aspect of the present disclosure, which winds a portion of a cable part and provides the cable part with an exercise load against an external force applied to the cable part, may include: a stator disposed on the outer side of a motor shaft in a circumferential direction; a rotor positioned on the outer side of the stator in the circumferential direction to be rotated by the stator, and coupled to the motor shaft to rotate together with the motor shaft; and a rotor sprocket formed along the outer surface of the motor shaft at the end thereof to rotate together with the motor shaft; a bobbin installed to be rotatable around a bobbin shaft and configured to wind a
(Continued)

portion of the cable part therearound; and a timing belt connecting the rotor sprocket and the bobbin to transmit the rotation force of the rotor sprocket to the bobbin.

20 Claims, 14 Drawing Sheets

(52) U.S. Cl.
CPC ..... *A63B 21/4033* (2015.10); *A63B 24/0062* (2013.01); *A63B 2208/0204* (2013.01); *A63B 2220/833* (2013.01)

(58) Field of Classification Search
CPC ..... A63B 2208/0204; A63B 2220/833; A63B 21/0059; A63B 21/157; A63B 21/4043; A63B 23/03508; A63B 23/03525; A63B 23/03541; A63B 24/0087; A63B 2024/0093; A63B 2220/54; A63B 2220/58; A63B 21/4035; A63B 24/00; H02K 7/10; H02K 11/215; H02K 21/22
See application file for complete search history.

(56) References Cited

U.S. PATENT DOCUMENTS

| | | | | |
|---|---|---|---|---|
| 2003/0203796 | A1 | 10/2003 | Yu | |
| 2019/0344123 | A1 | 11/2019 | Rubin et al. | |
| 2020/0047030 | A1* | 2/2020 | Ward | A63B 21/156 |
| 2020/0276465 | A1 | 9/2020 | Orady et al. | |
| 2021/0236876 | A1* | 8/2021 | Gregory | A63B 21/4035 |
| 2023/0405404 | A1* | 12/2023 | Belsham | A63B 24/0075 |
| 2024/0189651 | A1* | 6/2024 | Drayer | A63B 21/0059 |
| 2025/0288850 | A1* | 9/2025 | Nayak | A63B 21/00076 |

FOREIGN PATENT DOCUMENTS

| | | | | | |
|---|---|---|---|---|---|
| CN | 109416289 | | | 3/2019 | |
| CN | 109621330 | | | 4/2019 | |
| CN | 111601646 | | | 8/2020 | |
| CN | 111801167 | | | 10/2020 | |
| CN | 113332661 | | | 9/2021 | |
| CN | 115120466 | | | 9/2022 | |
| JP | 2022-547237 | | | 11/2022 | |
| KR | 10-2002-0076201 | | | 10/2002 | |
| KR | 20-2008-0002277 | | | 7/2008 | |
| KR | 10-2010-0089971 | | | 8/2010 | |
| KR | 10-2011-0072669 | | | 6/2011 | |
| KR | 10-2019-0061151 | | | 6/2019 | |
| KR | 10-2020-0025764 | | | 3/2020 | |
| KR | 10-2020-0079106 | | | 7/2020 | |
| KR | 2020 0079106 | | | 7/2020 | |
| KR | 10-2158338 | | | 11/2020 | |
| KR | 10-2188955 | | | 12/2020 | |
| KR | 10-2022-0162032 | | | 12/2022 | |
| KR | 20220162032 | A | * | 12/2022 | H02K 5/161 |
| KR | 10-2023-0050202 | | | 4/2023 | |
| KR | 20240033922 | A | * | 3/2024 | H02K 7/10 |
| WO | WO 2006-113415 | | | 10/2006 | |
| WO | WO2022212737 | | | 10/2022 | |
| WO | WO-2022212737 | A1 | * | 10/2022 | A63B 21/4043 |
| WO | WO 2022/235749 | | | 11/2022 | |

OTHER PUBLICATIONS

International Search Report (with English Translation) dated Jan. 31, 2024 issued in Application No. PCT/KR2023/017091.
Extended European Search Report dated May 12, 2025, issued in Application No. 23912518.0.
Korean Office Action dated Mar. 24, 2025, issued in Application No. 10-2023-0138249.
Korean Office Action dated Nov. 28, 2025 issued in Application No. 10-2024-7026767.
Chinese Office Action dated Jun. 11, 2026, issued in Application No. 202380020979.6.

* cited by examiner

DRIVING DEVICE AND EXERCISE EQUIPMENT INCLUDING SAME

CROSS-REFERENCE TO RELATED PATENT APPLICATIONS

This application is a U.S. National Stage Application under 35 U.S.C. § 371 of PCT Application No. PCT/KR2023/017091, filed Oct. 31, 2023, which claims priority to Korean Patent Application No. 10-2022-0188543, filed Dec. 29, 2022, whose entire disclosures are hereby incorporated by reference.

TECHNICAL FIELD

The present disclosure relates to a driving device and exercise equipment including the same and, more specifically, to a driving device that provides exercise loads to a user to enable strength training and exercise equipment including the same.

BACKGROUND

In general, exercise equipment used for strength training is configured to repeat muscle relaxation and contraction by pushing or pulling a lever and/or cable connected to a weight having a certain weight.

Exercise equipment used for strength training has been developed to have various shapes and structures depending on exercise parts of the user and purposes, and is being used. In addition, in recent years, home training, which involves exercising alone at home without visiting a fitness center, has become popular as a form of self-management, and in line with this trend, a variety of exercise equipment for home training is being proposed.

Among such exercise equipment, for example, there is mat-type exercise equipment that is a device for performing strength exercises while the user is standing on a main body of the exercise equipment. In the case of this mat-type exercise equipment, the user may perform an exercise by connecting a handle to a cable exposed to the outside of the main body and repeatedly pulling the handle.

In relation to the above-mentioned exercise equipment, Korean Unexamined Patent Publication No. 10-2023-0050202 (hereinafter referred to as "Prior Document 1") discloses mat-type exercise equipment.

Specifically, Prior Document 1 discloses exercise equipment enabling a user to do exercise while standing on the equipment seated on the floor, which includes a device body that provides exercise loads, a wire that extends from the device body to the outside to transmit the exercise load from the device body, and a handle guide module that is installed in the device body and guides extension of the wire from the device body to the outside.

The exercise equipment in Prior Document 1 discloses a structure in which a pair of wires extends from the device body and in which the exercise load generated from one driving motor is transferred to the wires respectively wound around bobbins through a differential having the bobbins provided at the top and bottom, instead of installing driving motors to the respective wires.

Accordingly, since the exercise equipment in Prior Document 1 has the bobbins provided at the top and bottom of the differential, the overall height of the driving structure is increased, so there it is difficult to make slim exercise equipment. In addition, since noise and vibration are inevitably generated due to transmission through engagement of gears inside the differential, a feeling of pulling the wires may deteriorate during exercise. In addition, it may be difficult to precisely detect or control the extension amount of each wire divided through the differential.

In addition, Japanese Unexamined Patent Publication No. 2022-547237 (hereinafter referred to as "Prior Document 2") discloses a fitness training device and system.

Specifically, Prior Document 2 also discloses exercise equipment enabling a user to do exercise while standing on the equipment seated on the floor, which includes a base, at least one retractable line installed in the base, and a load generator installed in the base to apply a selectively adjustable load to the line.

The exercise equipment in Prior Document 2 discloses a structure in which the rotational force of the motor is transmitted to a spool on which a cable is wound such that the cable is unwound to the outside, and in which the motor shaft is arranged transversely with respect to the base to transmit rotational force to the spool rotates around the transverse axis.

Accordingly, in the exercise equipment of Prior Document 2, the height of the base must be increased in order to use a motor with a relatively large radius, so it is difficult to increase the output of the motor due to the limited thickness of the exercise equipment. Additionally, the exercise equipment does not absolutely consider the structure capable of providing an exercise load at an appropriate load/pulling speed when using a motor of higher torque therein.

As described above, the exercise equipment used for strength training is required to be manufactured to be slim while providing an appropriate exercise load even if it uses a motor of higher torque. In addition, the exercise equipment is required to appropriately control the user's feeling of pulling the cable, and to precisely detect and control the pulled length of each of a plurality of cables, thereby improving the usability of the exercise equipment.

DISCLOSURE

Technical Problem

The present disclosure aims to solve the above problems with a driving device used for strength training and exercise equipment including the same.

Specifically, the present disclosure aims to provide a driving device capable of being manufactured to be slim while using a motor of higher torque by optimizing the structure of the driving device for providing an exercise load and exercise equipment including the same.

In addition, the present disclosure aims to provide a driving device capable of more easily and stably providing an exercise load to the user who performs strength training by optimizing the structure of the driving device for providing the exercise load and exercise equipment including the same.

In addition, the present disclosure aims to provide a driving device capable of minimizing the overall height with primary configurations that are appropriately arranged by optimizing the structure of the driving device for providing the exercise load and exercise equipment including the same.

The technical problems to be solved in the present disclosure are not limited to the technical problems mentioned above, and other technical problems not mentioned will be made clear to those skilled in the art to which the present disclosure belongs from the description below.

Technical Solution

In order to attain the foregoing or other purposes, a driving device according to one aspect of the present disclosure and exercise equipment including the same are configured to enable a slim structure even if the driving device providing an exercise load has higher torque. Specifically, the driving device is configured in an outer rotor structure in which the rotor is arranged on the outer side of a stator in the circumferential direction.

In addition, in the driving device according to one aspect of the present disclosure and the exercise equipment including the same, the driving device for providing an exercise load has a structure configured in consideration of the characteristics required for strength exercise. Specifically, the driving device is configured in a structure in which a driving motor and a bobbin are separated and connected through a timing belt according to the rotation ratio in the driving device.

In addition, the driving device according to one aspect of the present disclosure and the exercise equipment including the same are configured such that primary elements are arranged to prevent the overall height of the driving device from increasing. Specifically, the driving motor and the bobbin are configured to not overlap each other on a plane.

In addition, in the driving device according to one aspect of the present disclosure and the exercise equipment including the same, a motor shaft may be installed through a motor shaft housing and a motor shaft bearing.

In addition, the driving device according to one aspect of the present disclosure and the exercise equipment including the same may detect the rotation amount of the driving motor through an encoder magnet and an encoder sensor.

In addition, in the driving device according to one aspect of the present disclosure and the exercise equipment including the same, a rotor sprocket may include a first tooth body, a first belt guide, and a second belt guide.

In addition, in the driving device according to one aspect of the present disclosure and the exercise equipment including the same, the first tooth body may be divided into two portions that are to be integrally formed with the first belt guide and the second belt guide, respectively.

In addition, in the driving device according to one aspect of the present disclosure and the exercise equipment including the same, a bobbin body around which the cable part is wound and a bobbin sprocket to which the timing belt is fastened may be formed separately.

In addition, the driving device according to one aspect of the present disclosure and the exercise equipment including the same may include a bobbin guide that covers the outer circumferential side of the bobbin body.

In addition, in the driving device according to one aspect of the present disclosure and the exercise equipment including the same, the cable part may be wound according to the sequential heights between the bottom and top of the bobbin body.

In addition, the driving device according to one aspect of the present disclosure and the exercise equipment including the same may include a bobbin shaft that is installed through a bobbin shaft housing and a bobbin shaft bearing.

In addition, in the driving device according to one aspect of the present disclosure and the exercise equipment including the same, the bobbin sprocket may include a second tooth body, a third belt guide, and a fourth belt guide.

In addition, in the driving device according to one aspect of the present disclosure and the exercise equipment including the same, the second tooth body may be divided into two portions that are to be integrally formed with the third belt guide and the fourth belt guide.

In addition, in the driving device according to one aspect of the present disclosure and the exercise equipment including the same, a one-way clutch may be installed on the transmission path of the inertial rotation force.

In addition, in the driving device according to one aspect of the present disclosure and the exercise equipment including the same, the driving motor used in the driving device is configured in a structure capable of producing rotation force around a longitudinal motor shaft.

In addition, in the driving device according to one aspect of the present disclosure and the exercise equipment including the same, the body part may be formed to be long in a first direction, and the cable part may be installed to be exposed from the end portion of the body part in the first direction.

In addition, in the driving device according to one aspect of the present disclosure and the exercise equipment including the same, the driving motor may be disposed inward from the outlet in the first direction, and the bobbin may be disposed in the second direction intersecting the first direction.

In addition, in the driving device according to one aspect of the present disclosure and the exercise equipment including the same, the bobbin may be lopsidedly disposed from the outlet with respect to the extension line along the first direction so as to maximize the area of the driving motor.

In addition, in the driving device according to one aspect of the present disclosure and the exercise equipment including the same, the cable part extending from the biased bobbin in the first direction may be bent at the articulation pulley and extend to the outlet.

In addition, in the driving device according to one aspect of the present disclosure and the exercise equipment including the same, a plurality of cable parts may be disposed in the body part, and the driving device for providing an exercise load may be installed in each cable part.

Solutions to problems sought to be achieved in the present disclosure are not limited to those mentioned above, and other solutions not mentioned above may be clearly understood by those skilled in the art to which the present disclosure belongs from the description below.

DETAILED DESCRIPTION

Hereinafter, preferred embodiments of the present disclosure will be described in detail with reference to the attached drawings. However, in describing the present disclosure, descriptions of already known functions or configurations will be omitted to make the subject matter of the present disclosure clear.

The X direction, Y direction, and Z direction to be described in the embodiments of the present disclosure may be directions orthogonal to each other. Each of the X and Y directions may be parallel to the horizontal direction, and the Z direction may be parallel to the vertical direction. If the X direction is parallel to the left/right direction, the Y direction may be parallel to the front/back direction. If the X direction is parallel to the front/back direction, the Y direction may be parallel to the left/right direction.

Figure 1:
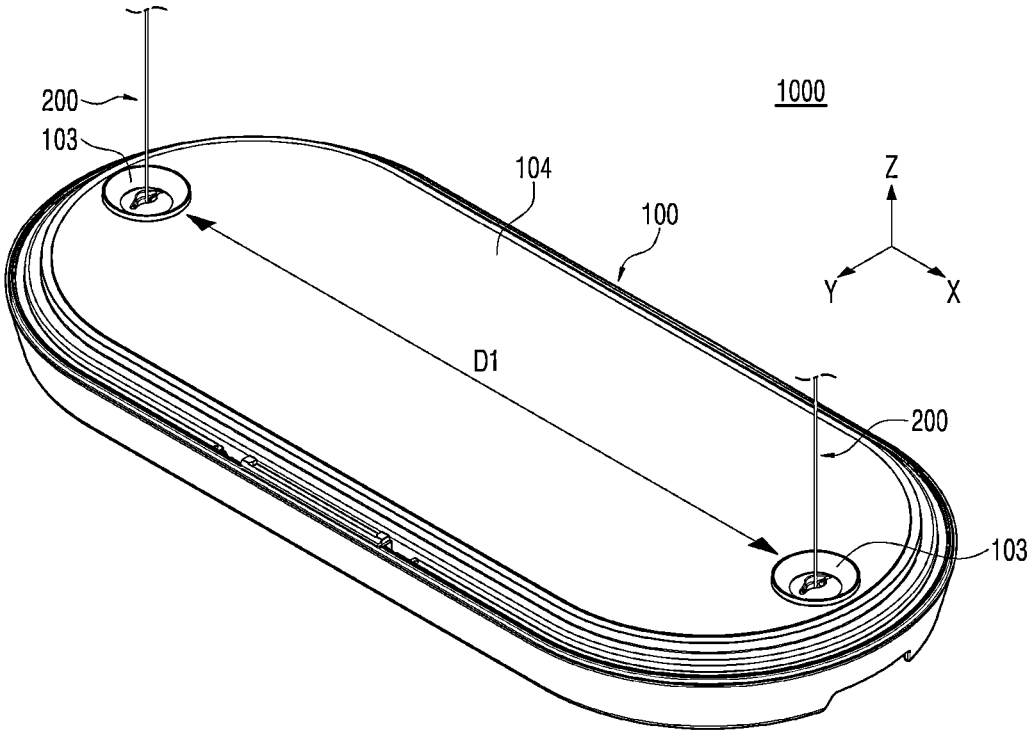
FIG. 1 is a perspective view illustrating exercise equipment according to an embodiment of the present disclosure.
Figure 2:
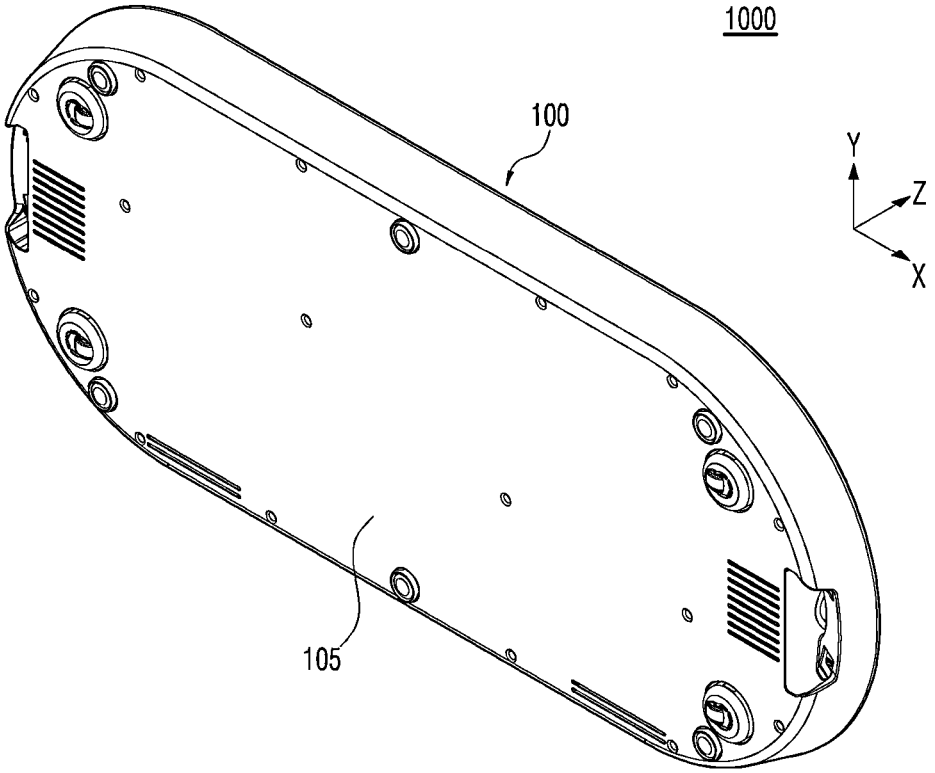
FIG. 2 is a diagram illustrating the exercise equipment in FIG. 1 viewed from another direction.
Figure 3:
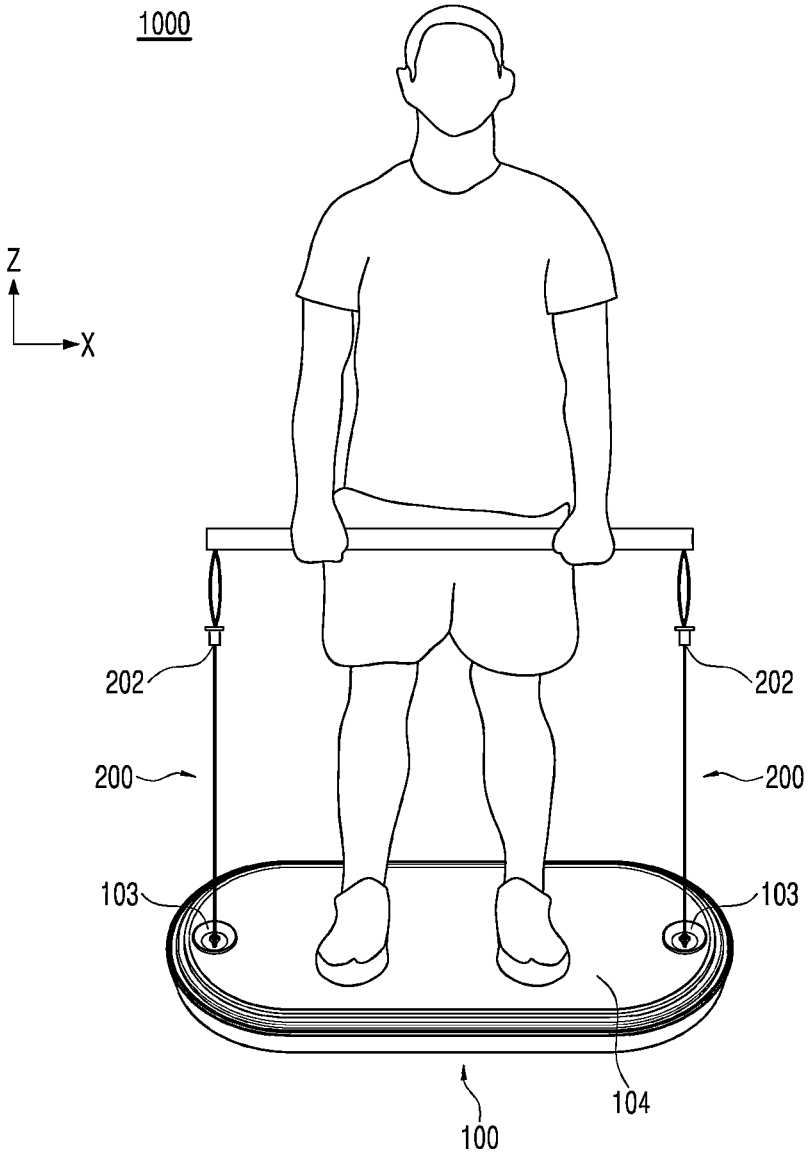
FIGS. 3 and 4 are diagrams illustrating the state of using exercise equipment according to an embodiment of the present disclosure.
Figure 4:
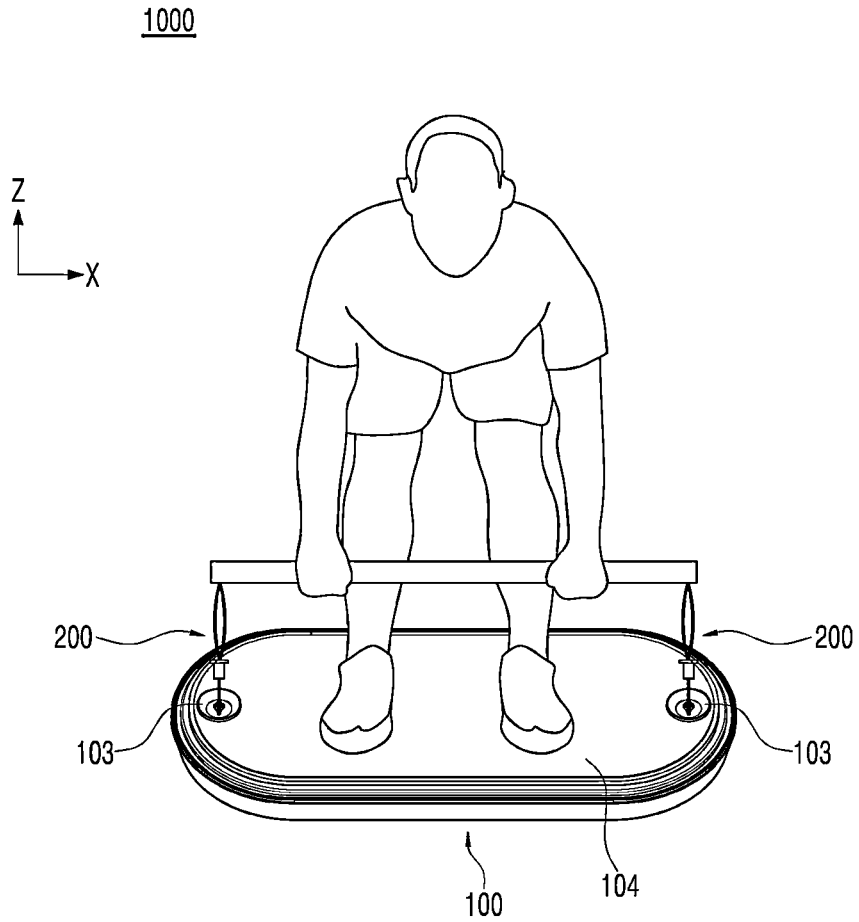

FIG. 1 is a perspective view illustrating exercise equipment 1000 according to an embodiment of the present disclosure. FIG. 2 is a diagram illustrating the exercise equipment 1000 in FIG. 1 viewed from another direction. FIGS. 3 and 4 are diagrams illustrating the state of using exercise equipment 1000 according to an embodiment of the present disclosure.

Referring to FIGS. 1 to 4, the exercise equipment 1000 according to an embodiment of the present disclosure may be used such that the user stands on the exercise equipment 1000 and exercises while being seated on the floor indoors or outdoors.

Specifically, the user may get on the upper surface 104 of a body part 100 with the exercise equipment 1000 installed such that the lower surface 105 of the body part 100 faces the floor, thereby exercising.

In this case, a cable part 200 is installed to extend from the inside of the body part 100 to the outside such that a portion thereof is exposed, and the user may pull the exposed portion of the cable part 200 to perform an exercise.

In particular, when the user pulls the exposed portion of the cable part 200, an exercise load that resists the user's pulling force may be applied to the cable part 200 accommodated inside the body part 100.

Therefore, as shown in FIGS. 3 and 4, the exposed length of the cable part 200 may be increased and reduced by the force of the user pulling the cable part 200 and the exercise load that resists the force. In addition, repeating this process may apply an exercise load to the user, thereby obtaining the effect of strength training.

Meanwhile, FIGS. 3 and 4 show an example in which a user exercises by connecting a bar-shaped handle to the cable part 200, but the state in which the user uses the exercise equipment 1000 is not necessarily limited thereto and may vary depending on the user's exercise part and purposes.

Figure 5:
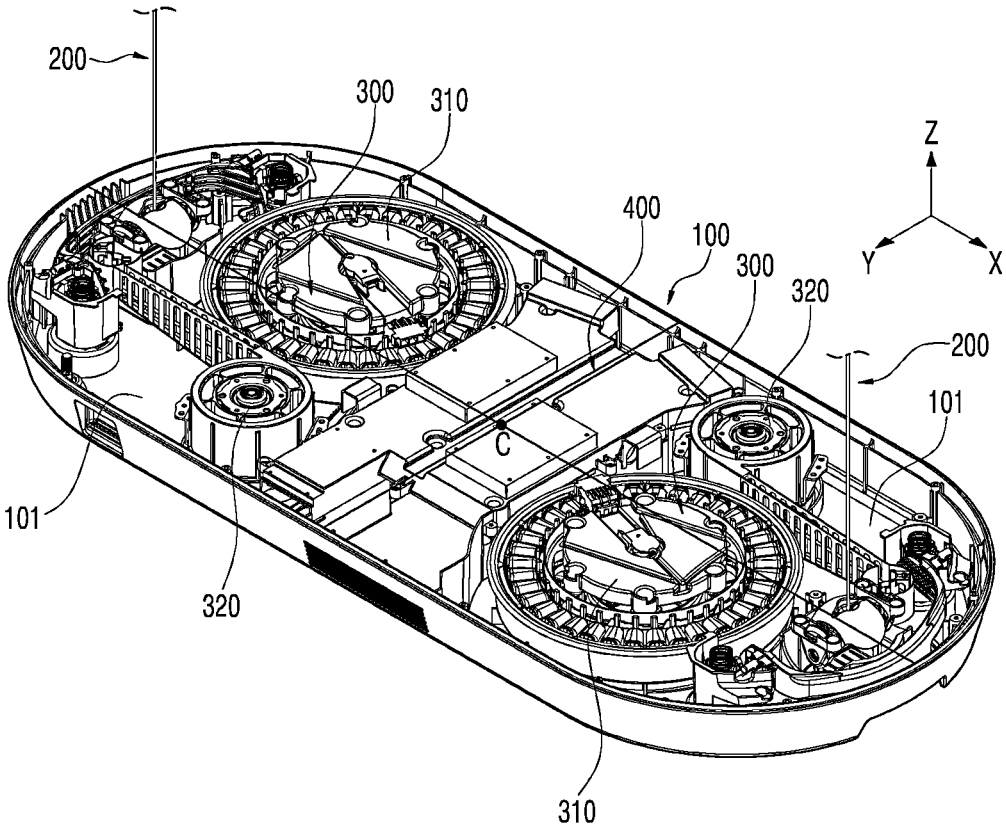
FIG. 5 is a diagram illustrating the primary configurations arranged in an accommodation space in exercise equipment according to an embodiment of the present disclosure.
Figure 6:
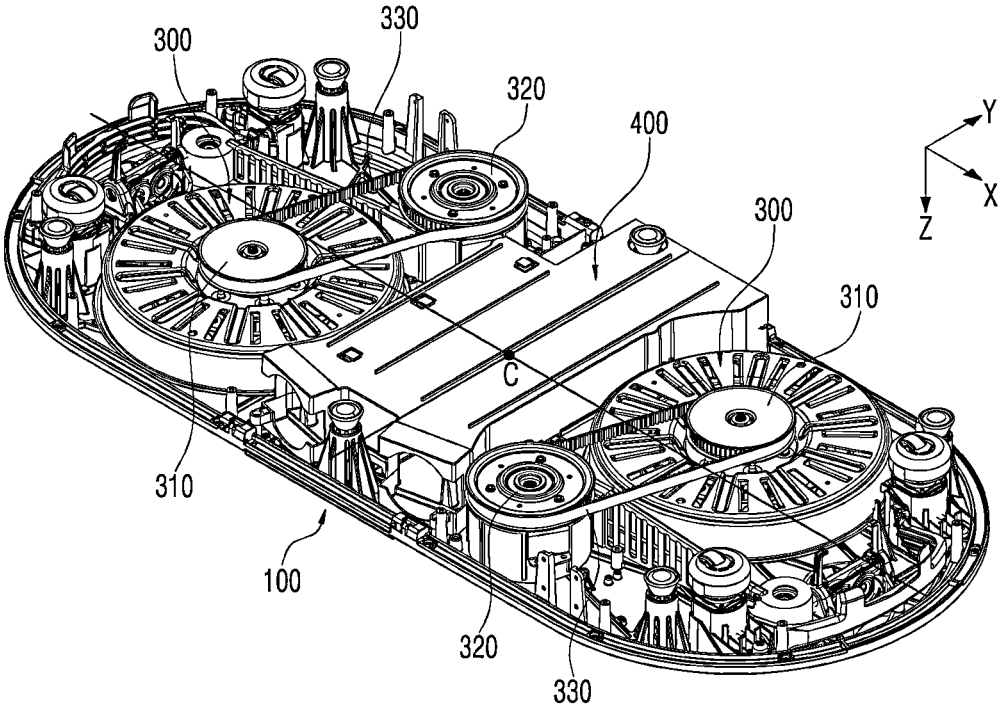
FIG. 6 is a view illustrating the primary configurations in FIG. 5 viewed from another direction.

FIG. 5 is a drawing illustrating primary elements arranged in an accommodation space 101 in exercise equipment 1000 according to an embodiment of the present disclosure. FIG. 6 is a drawing illustrating the primary elements illustrated in FIG. 5, which are viewed from a different direction.

The exercise equipment 1000 according to an embodiment of the present disclosure includes a body part 100, a cable part 200, and a driving device 300.

The body part 100 may have an accommodation space 101 formed therein and an upper surface 104 formed in a plate shape, and may form the primary exterior of the exercise equipment 1000 according to the present embodiment.

Here, the accommodation space 101 is an empty space formed inside the body part 100, and may be a space surrounded by the upper surface 104, the lower surface 105, and the side surfaces of the body part 100. Additionally, the upper surface 104 of the body part 100 may be a surface directed to the Z direction, and the lower surface 105 of the body part 100 may be a surface directed to the opposite direction of the Z direction in FIGS. 1 to 6.

That is, the primary configurations of the exercise equipment 1000 according to the present embodiment may be installed in the accommodation space 101 corresponding to the internal space of the body part 100. In addition, a portion of the cable part 200 installed in the accommodation space 101 of the body part 100 may be exposed to the outside of the body part 100.

Accordingly, the user may perform an exercise by pulling the cable part 200 exposed to the outside of the body part 100 while standing on the upper surface 104 of the body part 100 formed in a plate shape.

The cable part 200 has one end 201 coupled to the accommodation space 101 and the other end 202 exposed to the outside through the outlet 103 of the body part 100, so that the exposed length varies by external force.

Here, one end 201 of the cable part 200 may be one end in the longitudinal direction (or a section from the end to a predetermined length), and the other end 202 of the cable part 200 may be the opposite end in the longitudinal direction (or a section from the end to a predetermined length).

In this case, the outlet 103 may be a through hole formed in a portion of the body part 100, and the cable part 200 may extend from the inside of the body part 100 to the outside through the outlet 103. In addition, the cable part 200 may include a cable, a wire, a rope, or a belt that is formed to extend along the length direction, and the tensile force applied to the part may be transmitted along the length direction.

Accordingly, the external force with which the user pulls on the other end 202 of the cable part 200 may be transmitted to one end 201 of the cable part 200 along the longitudinal direction. In addition, an exercise load may be applied to one end 201 of the cable part 200 coupled to the accommodation space 101 by a driving device 300, which will be described later, and this exercise load may be transmitted to the other end 202 of the cable part 200 along the longitudinal direction.

Therefore, if the user pulls the cable part 200 with an external force greater than the exercise load, the exposed length of the cable part 200 may increase. On the other hand, if the external force with which the user pulls the cable part 200 is smaller than the exercise load, the pulled cable part 200 may return to its original position so that the exposed length of the cable part 200 is reduced.

The driving device 300 winds a portion of the cable part 200 and provides an exercise load to the cable part 200 to resist external force. This driving device 300 may be disposed in the accommodation space 101 so as to be coupled to one end 201 of the cable part 200.

That is, the driving device 300 may provide the cable part 200 with an exercise load in a direction in which the exposed portion of the cable part 200 retracts back into the accommodation space 101 of the body part 100.

Therefore, in the process of pulling the cable part 200, the user may feel the exercise load provided from the driving device 300 and adjust the external force for pulling the cable part 200 in response to the exercise load of the driving device 300, thereby performing intended exercises.

Figure 7:
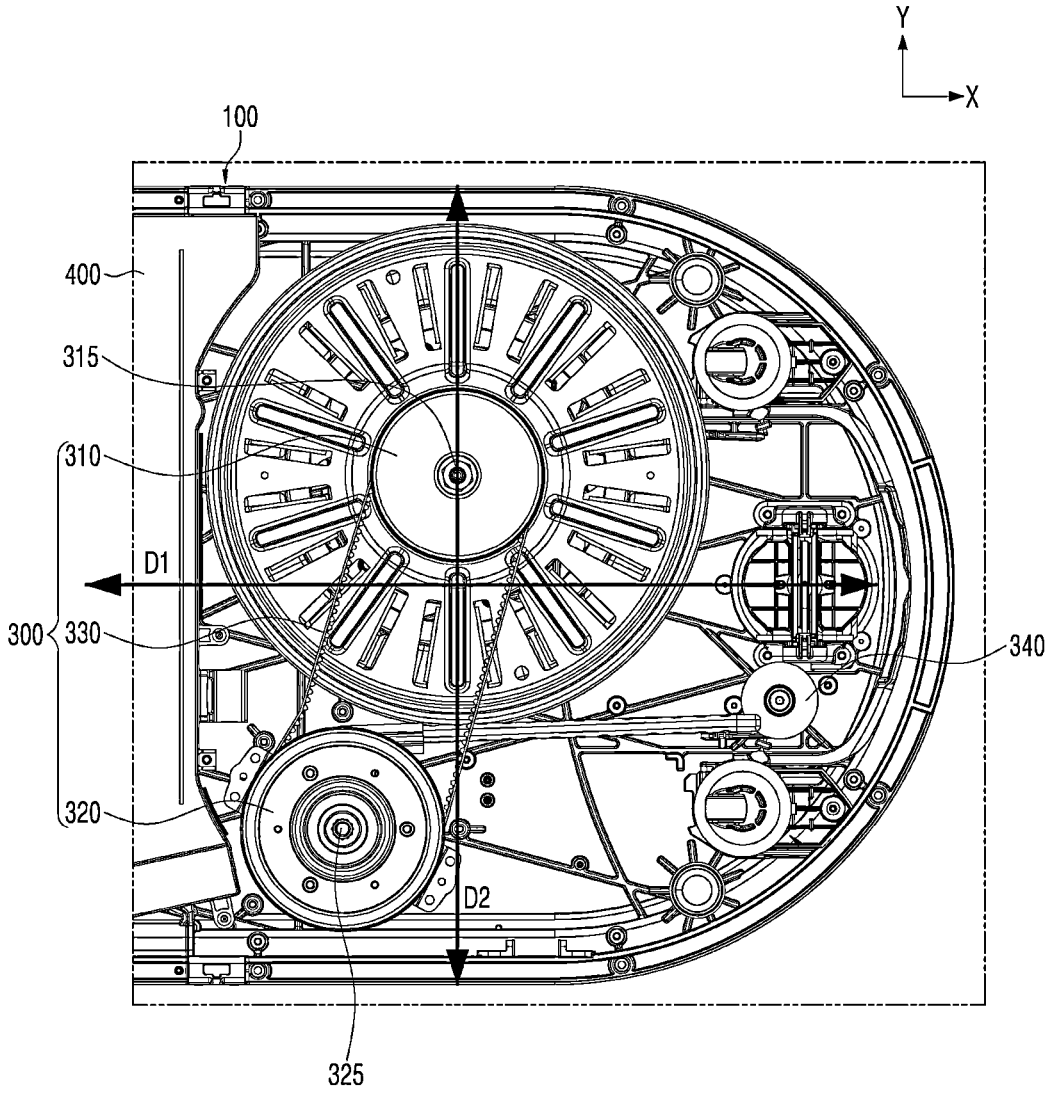
FIG. 7 is a drawing illustrating a driving device in exercise equipment according to an embodiment of the present disclosure.
Figure 8A:
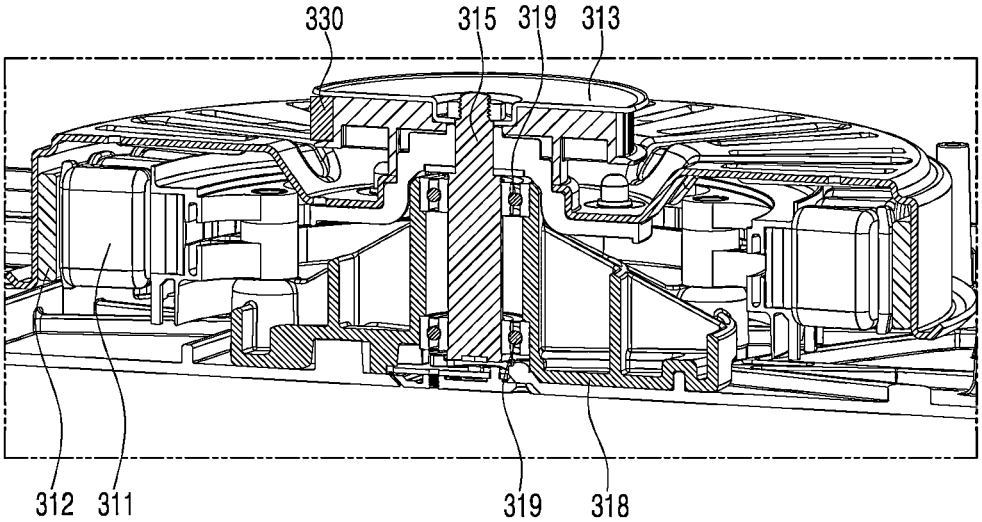
FIG. 8A and FIG. 8B are drawings illustrating a driving motor in the driving device shown in FIG. 7.
Figure 8B:
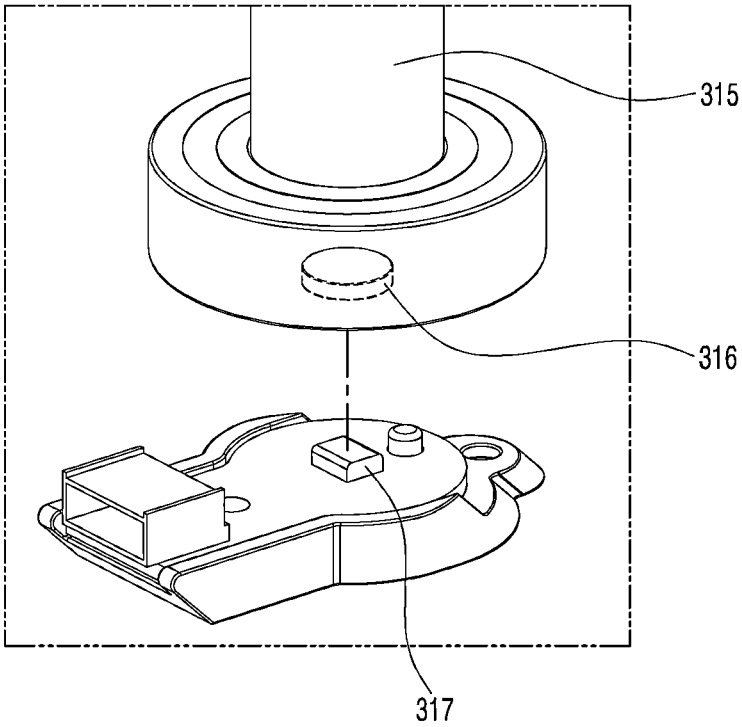

FIG. 7 is a drawing illustrating a driving device 300 in exercise equipment 1000 according to an embodiment of the present disclosure. FIG. 8A and FIG. 8B are drawings illustrating a driving motor 310 in the driving device 300 shown in FIG. 7.

In the exercise equipment 1000 according to an embodiment of the present disclosure, the driving device 300 may include a driving motor 310, a bobbin 320, and a timing belt 330.

The driving motor 310 may generate rotation force by electrical energy and may generate power for the exercise load provided from the driving device 300.

In particular, the driving motor 310 may be installed to generate rotational force around a motor shaft 315 in the longitudinal direction. Here, the longitudinal direction may be a direction parallel to the Z direction with respect to the plane of the body part 200.

Accordingly, the rotation radius of the driving motor 310 may be expanded along the X and Y directions on the plane of the body part 200, and even if the height of the driving motor 310 is not expanded in the Z direction, rotational force of high torque may be generated according to the expanded rotation radius.

As described above, the exercise equipment 1000 according to an embodiment of the present disclosure has a structure in which the driving motor 310 used in the driving device 300 generates rotation force around the motor shaft 315 in the longitudinal direction, even if the driving device 300 has high torque using a driving motor 310 with a larger radius, the device may be manufactured to be slim.

Meanwhile, since the driving motor 310 is configured as a motor that is directly driven by minimizing intermediate mechanisms (gears, pulleys, reducers, and the like), such as a direct drive (DD) motor, it may generate high output power with higher torque and have a wide rotation range.

In particular, since the direct drive (DD) motors has a heavy weight, it may increase the weight of the exercise equipment 1000 to ensure that the body part 100 remains stable on the ground during use.

The bobbin 320 may be installed to be rotatable around the bobbin shaft 325 such that one end 201 of the cable part 200 is wound therearound, and the exposed length of the cable part 200 exposed to the outside of the body part 100 may vary depending on the degree in which the cable part 200 is wound around the bobbin 320.

In other words, the bobbin 320 may be rotated by receiving rotational force generated from the driving motor 310 through the timing belt 330, which will be described later. In particular, if the bobbin 320 is rotated in a direction in which more of the cable part 200 is wound around the bobbin 320, the exposed portion of the cable part 200 may be pulled back into the accommodation space 101 of the body part 100.

The timing belt 330 may connect the driving motor 310 and the bobbin 320 to rotate the bobbin 320 by the rotational force of the driving motor 310, and may transmit the rotational force generated by the driving motor 310 to the bobbin 320 with some compensation depending on the rotation ratio between the driving motor 310 and the bobbin 320.

Specifically, as described above, in the case where the driving motor 310 is configured as a motor with high torque, such as a direct drive (DD) motor, if the driving motor 310 is directly connected to the cable part 200, the torque/rotation characteristics of the driving motor 310 may not be suitable for the load/pulling speed required for strength training.

That is, since the power generated from the driving motor 310 is high output with higher torque, if it is connected directly to the cable part 200, the exercise load may be very high and may be quickly provided to the cable part 200.

However, it may be desirable for the user using the exercise equipment 1000 that the exercise load is gradually applied in several stages in consideration of exercise efficiency.

Therefore, it may be desirable to separately configure the driving motor 310 and the bobbin 320, instead of directly connecting the driving motor 310 to the cable part 200 as described above, so that the driving motor 310 and the bobbin 320 are connected to the timing belt 330.

In this case, the bobbin shaft 325, like the motor shaft 315, may be arranged along the longitudinal direction in the accommodation space 101.

As described above, in the exercise equipment 1000 according to an embodiment of the present disclosure, the driving device 300 is configured such that the driving motor 310 and the bobbin 320 are separated in the driving device 300 and connected to the timing belt 330 according to the rotation ratio, thereby configuring an optimal structure of the driving device 300 in consideration of both the torque/rotation characteristics of the driving motor 310 and the load/pulling speed required for strength exercise.

In addition, as described above, in order to manufacture the device with a slim thickness even though it has high torque, it may be desirable to separate the driving motor 310 and bobbin 320 in the driving device 300 to minimize the height of the driving motor 310.

In the exercise equipment 1000 according to an embodiment of the present disclosure, the body part 100 may be formed to be long along a first direction D1 on a plane, and the outlet 103 may be formed on the end portion in the first direction D1. In this case, the cable part 200 may be exposed to the outside of the body part 100 through the outlet 103.

Here, as shown in FIGS. 1 and 7, the first direction D1 may be a direction (left/light direction) parallel to the X direction, and a second direction D2 intersecting the first direction D1 may be a direction (front/back direction) parallel to the Y direction. In addition, the end portion in the first direction D1 may be a section extending to a predetermined length from the end of the body part 100 in the first direction D1.

The upper surface 104 of the body part 100 may be formed in a long plate shape along the first direction D1.

The length of the body part 100 in the first direction D1 may be determined in consideration of the shoulder width of the user, and the length of the body part 100 in the second direction D2 may be determined in consideration of the chest thickness of the user.

An outlet 103 may be formed on the end portion of the upper surface 104 of the body part 100 in the first direction D1, and the cable part 200 may be exposed through the outlet 103. Accordingly, the outlets 103 may be formed on both end portions of the body part 100 formed long in the first direction D1, and a pair of cable parts 200 may be exposed through the outlets 103.

Therefore, the user may perform an exercise of simultaneously pulling each cable part 200 by each arm, and this may be a common and preferred exercise type that may be performed using the exercise equipment 1000 according to the present embodiment.

As described above, in the exercise equipment 1000 according to an embodiment of the present disclosure, since the body part 100 is formed to be long in the first direction D1, and since the cable part 200 is installed to be exposed from the end portion of the body part 100 in the first direction D1, the user may effectively perform strength exercises using both arms while standing on the body part 100.

In the exercise equipment 1000 according to an embodiment of the present disclosure, the driving motor 310 (rotor 312) may be disposed inward from the outlet 103 in the first direction D1, and the bobbin 320 may be disposed with respect to the driving motor 310 in the second direction D2 intersecting the first direction D1 on a plane.

Here, the inward position in the first direction D1 may be a position on the body part 100 in the first direction D1, which is not outside the outlet 103. That is, in the case where the first direction D1 is the left/right direction, the driving motor 310 (rotor 312) may be disposed on the right side of the outlet 103 on the left end portion, and the driving motor 310 (rotor 312) may be disposed on the left side of the outlet 103 on the right end portion.

If both the driving motor 310 (rotor 312) and the bobbin 320 are arranged on the line extending from the outlet 103 in the first direction D1, the length of the body part 100 in the first direction D1 may become too long.

In addition, if both the driving motor 310 (rotor 312) and the bobbin 320 are disposed in the same Z direction, there may be a problem in which the thickness of the body part 100 must be increased by the combined thickness of the driving motor 310 (rotor 312) and the bobbin 320.

Accordingly, the arrangement in which the driving motor 310 (rotor 312) is disposed in the first direction D1 from the outlet 103 and in which the bobbin 320 is disposed in the second direction D2 from the driving motor 310 (rotor 312) may solve all of the above problems.

As described above, in the exercise equipment 1000 according to an embodiment of the present disclosure, since the driving motor 310 (rotor 312) is disposed inward from the outlet 103 in the first direction D1, and since the bobbin 320 is disposed in the second direction D2 intersecting the first direction D1, the driving motor 310 (rotor 312) and the bobbin 320, which are separately disposed, may be appropriately disposed without overlapping each other on the plane.

In exercise equipment 1000 according to an embodiment of the present disclosure, the driving motor 310 (rotor 312) may be disposed to have a larger area than the bobbin 320, and the bobbin 320 may be disposed lopsidedly from the outlet 103 with respect to the extension line along the first direction D1.

In order to install the driving motor 310 of high torque inside a limited accommodation space 101, a driving motor 310 (rotor 312) with a larger radius needs to be installed. In this case, the bobbin 320 may have a sufficient radius to change the torque of the driving motor 310 according to the rotation ratio, and does not need to have an excessively large radius.

Accordingly, the driving motor 310 (rotor 312) and the bobbin 320 may be installed such that the driving motor 310 (rotor 312) is to have a size capable of occupying more sections than the bobbin 320 in the second direction D2.

As described above, in the exercise equipment 1000 according to an embodiment of the present disclosure, since the bobbin 320 is lopsidedly disposed from the outlet 103 with respect to the extension line along the first direction D1 so as to maximize the area of the driving motor 310, it is possible to secure a maximal space for arrangement of the driving motor 310 (rotor 312).

In the exercise equipment 1000 according to an embodiment of the present disclosure, the driving device 300 may further include an articulation pulley 340 disposed on the end portion in the first direction D1 from the bobbin 320. In this case, the cable part 200 may extend from the bobbin 320 to the articulation pulley 340 in the first direction D1 and may be bent at the articulation pulley 340 to extend to the outlet 103.

As described above, in the case where the bobbin 320 is lopsidedly disposed, the direction of the cable part 200 extending from the bobbin 320 to the outlet 103 may not be parallel to the first direction D1 (X direction). That is, the cable part 200 may be disposed in a diagonal direction on the plane of the body part 100, which may cause interference with other components disposed in the accommodation space 101.

It is not desirable for the cable part 200 to be disposed in a diagonal direction on the plane of the body part 100 as described above, so it may be desirable for the cable part 200 to extend from the bobbin 320 to the articulation pulley 340 in the first direction D1 and then bend at the articulation pulley 340 toward the outlet 103.

As described above, in the exercise equipment 1000 according to an embodiment of the present disclosure, since the cable part 200 extending from the biased bobbin 320 in the first direction D1 is bent at the articulation pulley 340 and extends to the outlet 103, even if the bobbin 320 is lopsidedly disposed, the cable part 200 may extend without interference with other components.

In exercise equipment 1000 according to an embodiment of the present disclosure, the driving motor 310 may include a stator 311, a rotor 312, and a rotor sprocket 313. In particular, the driving motor 310 may have an outer rotor structure in which the stator 311 is formed relatively inward and the rotor 312 is formed relatively outward.

The stator 311 may be disposed outward from the motor shaft 315 in the circumferential direction thereof, and may generate magnetic flux when current flows through the coil structure.

The rotor 312 is positioned outward from the stator 311 in the circumferential direction thereof so as to be rotated by the stator 311, and is coupled to the motor shaft 315 to rotate together with the motor shaft 315. That is, the rotor 312 may generate magnetic flux in a magnet structure in which N and S poles are alternately arranged. In addition, the interaction between the magnetic flux generated in the stator 311 and the magnetic flux generated in the rotor 312 may rotate the rotor 312 together with the motor shaft 315, generating torque in the driving motor 310.

The outer rotor structure above has a larger rotation radius of the rotor 312 than the inner rotor structure, thereby generating a larger torque.

The rotor sprocket 313 is formed along the outer surface at the end of the motor shaft 315 to rotate together with the motor shaft 315, and a portion of the timing belt 330 is fastened thereto.

That is, when the motor shaft 315 rotates due to the rotation of the rotor 312, the rotor sprocket 313 formed at the end of the motor shaft 315 also rotates to transmit rotational force to the timing belt 330.

As described above, in the exercise equipment 1000 according to an embodiment of the present disclosure, since the driving device 300 is configured in an outer rotor structure in which the rotor 312 is arranged on the outer side of the stator 311 in the circumferential direction, the driving device 300 may be manufactured to be slim even if the driving device 300 has high torque with the driving motor 310 of a larger radius.

In the exercise equipment 1000 according to an embodiment of the present disclosure, the bobbin shaft 325 may be arranged parallel to the motor shaft 315 on the outer side of the rotor 312 in the circumferential direction.

That is, as illustrated in FIG. 7, the bobbin shaft 325 may be arranged on the outer side of the rotor 312 on a plane and may be formed along the same direction as the motor shaft 315 to rotate axially.

Accordingly, the bobbin 320 that rotates around the bobbin shaft 325 may be display at a position that does not overlap the driving motor 310 (rotor 312) on a plane. In addition, since the bobbin shaft 325 is disposed parallel to the motor shaft 315, the timing belt 330 that transmits the rotation force of the driving motor 310 to the bobbin 320 may be disposed at a certain height.

As described above, in the exercise equipment 1000 according to an embodiment of the present disclosure, since the driving device 300 is configured in a structure in which the driving motor 310 and the bobbin 320 do not overlap each other on a plane, it is possible to appropriately dispose the driving motor 310 and the bobbin 320 while preventing the overall height of the driving device 300 from increasing.

In an embodiment of the exercise equipment 1000 according to the present disclosure, the driving device 300 may further include a motor shaft housing 318 and a motor shaft bearing 319.

The motor shaft housing 318 may allow the motor shaft 315 to pass therethrough to restrict movement of the motor shaft 315, and may support the motor shaft 315 without restricting the axial rotation of the motor shaft 315.

To this end, the motor shaft housing 318 may be coupled to the body part 100 so as to support the motor shaft 315 while restricting the movement of the motor shaft housing 318.

The motor shaft bearing 319 may be interposed between the motor shaft 315 and the motor shaft housing 318 to reduce the frictional resistance of the motor shaft 315 against the motor shaft housing 318.

That is, as shown in FIG. 8A, the motor shaft 315 may be installed to pass through the motor shaft housing 318, and the motor shaft bearing 319 may be interposed at a portion where the motor shaft 315 comes into contact with the motor shaft housing 318.

In this case, a plurality of motor shaft bearings 319 may be provided in various structures and arrangements capable of reducing the frictional resistance between the motor shaft 315 and the motor shaft housing 318 when the motor shaft 315 rotates.

As described above, in the exercise equipment 1000 according to an embodiment of the present disclosure, since the motor shaft 315 is installed through the motor shaft housing 318 and the motor shaft bearing 319, the motor shaft 315 may be installed to be rotatable while being stably supported.

In the exercise equipment 1000 according to an embodiment of the present disclosure, the driving device 300 may further include an encoder magnet 316 and an encoder sensor 317.

The encoder magnet 316 is installed on the motor shaft 315 to rotate together with the motor shaft 315, and the encoder sensor 317 is disposed to be spaced apart from the motor shaft 315 to sense the rotation of the encoder magnet 316.

That is, when the motor shaft 315 rotates, the encoder magnet 316 installed on the motor shaft 315 also rotates, and a change in magnetic flux may be generated by the encoder magnet 316. In addition, such a change in magnetic flux may be sampled by the encoder sensor 317 and converted into an electric pulse, thereby detecting the position (amount of rotation) of the motor shaft 315.

As described above, since the exercise equipment 1000 according to an embodiment of the present disclosure recognizes the rotation amount of the driving motor 310 through the encoder magnet 316 and the encoder sensor 317, it is easier to control the driving motor 310.

Figure 9:
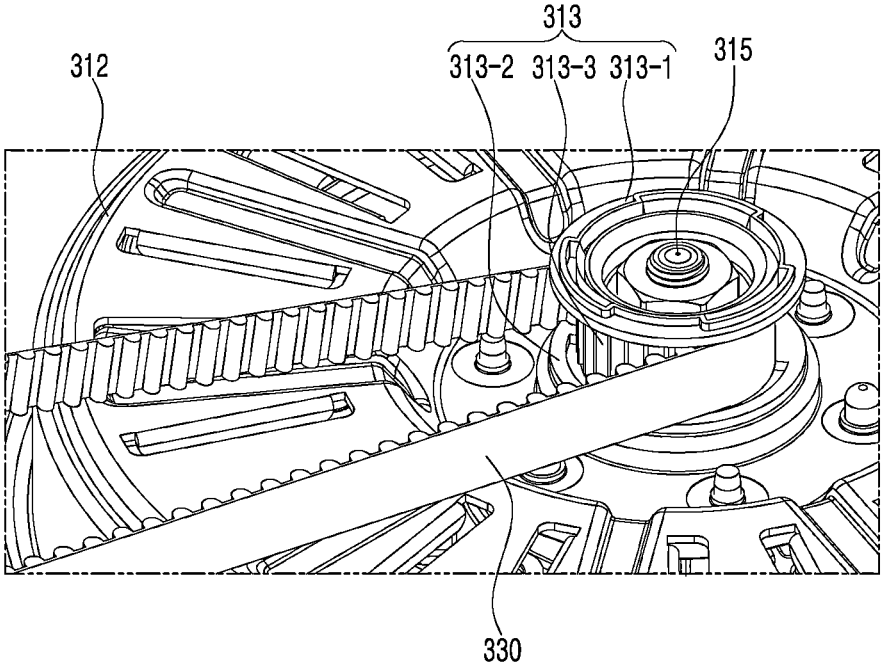
FIG. 9 is a drawing illustrating the state in which a timing belt is fastened to a rotor sprocket in the driving device shown in FIG. 7.
Figure 10:
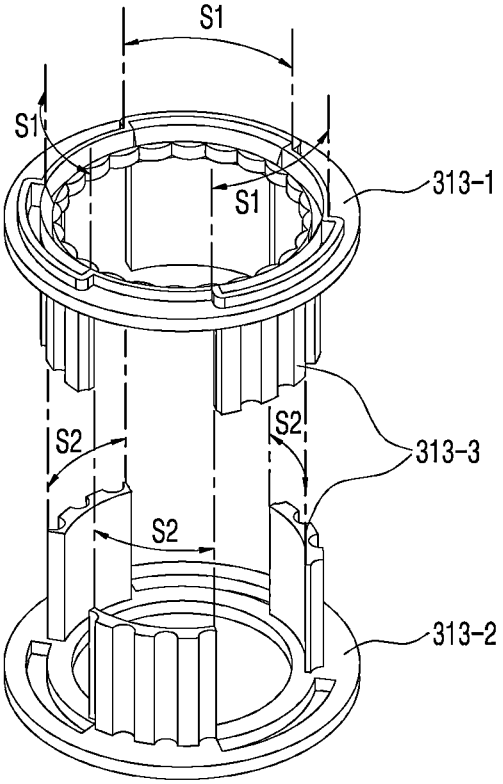
FIG. 10 is a drawing illustrating the structure of the rotor sprocket in the driving device shown in FIG. 7 in more detail.

FIG. 9 is a drawing illustrating the state in which a timing belt 330 is fastened to a rotor sprocket 313 in the driving device 300 shown in FIG. 7. FIG. 10 is a drawing illustrating the structure of the rotor sprocket 313 in the driving device 300 shown in FIG. 7 in more detail.

In the exercise equipment 1000 according to an embodiment of the present disclosure, the rotor sprocket 313 may include a first tooth body 313-3, a first belt guide 313-1, and a second belt guide 313-2.

The first tooth body 313-3 may have an outer surface that is toothed to be engaged with the timing belt 330 and rotate axially by frictional force with the timing belt 330.

In this case, as shown in FIG. 9, the outer surface of the first tooth body 313-3 may be toothed, and the timing belt 330 may also be toothed corresponding to the toothed outer surface, so that rotation force may be transmitted in the state in which the toothed surface of the timing belt 330 and the toothed surface of the first tooth body 313-3 are engaged.

The first belt guide 313-1 is formed to protrude in the circumferential direction from one side of the first tooth body 313-3 in the axial direction of the motor shaft 315, and the second belt guide 313-2 is formed to protrude in the circumferential direction from the other side of the first tooth body 313-3 in the axial direction of the motor shaft 315.

That is, as shown in FIG. 9, the first belt guide 313-1 and the second belt guide 313-2 may be formed to protrude both sides of the first tooth body 313-3, respectively, in the axial direction of the motor shaft 315.

Accordingly, the timing belt 330 wound around the outer surface of the first tooth body 313-3 may be prevented from being separated from the motor shaft 315 in the axial direction.

As described above, in the exercise equipment 1000 according to an embodiment of the present disclosure, since the rotor sprocket 313 includes the first tooth body 313-3, the first belt guide 313-1, and the second belt guide 313-2, it is possible to prevent the timing belt 330 from being separated from the rotor sprocket 313 when transmitting rotation force through the timing belt 330.

In the exercise equipment 1000 according to an embodiment of the present disclosure, the first belt guide 313-1 may be formed integrally with a portion of the first tooth body 313-3 in the first section S1. In this case, the second belt guide 313-2 may be formed integrally with the remaining portion of the first tooth body 313-3 in the second section S2 that does not overlap the first section S1.

That is, as illustrated in FIG. 10, the first tooth body 313-3 may be formed to be divided into the first section S1 and the second section S2. In addition, the first tooth body 313-3 in the first section S1 may be formed integrally with the first belt guide 313-1, and the first tooth body 313-3 in the second section S2 may be formed integrally with the second belt guide 313-2.

As described above, if the rotor sprocket 313 is configured in a structure in which the first belt guide 313-1 and the second belt guide 313-2 are formed to protrude from both sides of the first tooth body 313-3, respectively, in the axial direction of the motor shaft 315, it may be difficult to integrally injection-mold the rotor sprocket 313 at once.

That is, if the injection mold is to be configured with an upper mold for forming the upper surface of the rotor sprocket 313 and a lower mold for forming the lower surface of the rotor sprocket 313, there may be a problem with undercuts or the like because the first belt guide 313-1 and the second belt guide 313-2 vertically overlap each other.

Therefore, it may be a way to increase the efficiency of manufacturing that the first belt guide 313-1 and the second belt guide 313-2 are manufactured separately from each other and that the first tooth body 313-3 is divided and integrally formed with the first belt guide 313-1 and the second belt guide 313-2, respectively.

As described above, in the exercise equipment 1000 according to an embodiment of the present disclosure, since the first tooth body 313-3 is divided into two portions that are to be integrally formed with the first belt guide 313-1 and the second belt guide 313-2, respectively, the rotor sprocket 313 may be easily manufactured using a mold.

Figure 11A:
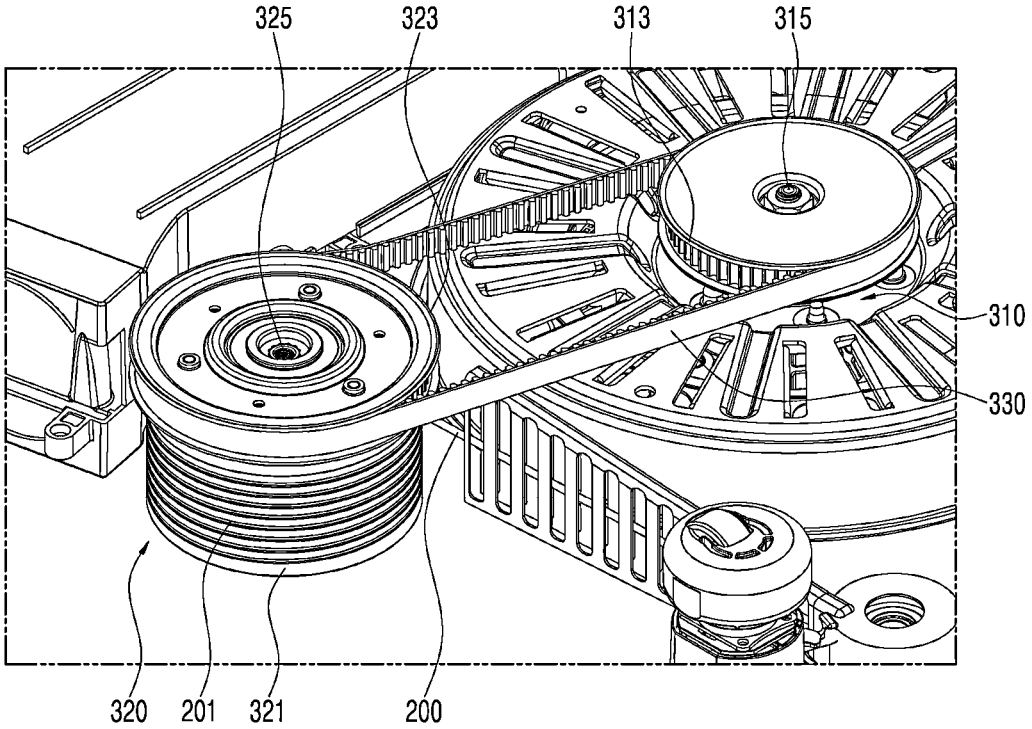
FIG. 11A and FIG. 11B are drawings illustrating a bobbin in the driving device shown in FIG. 7.
Figure 11B:
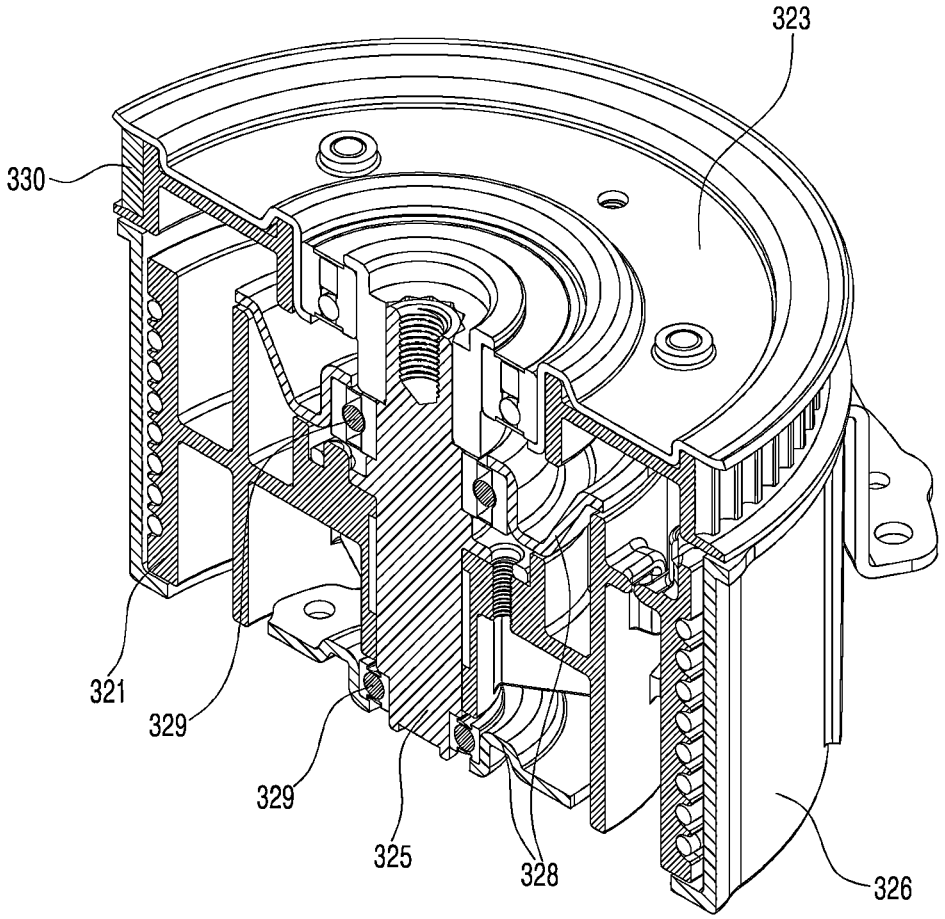

FIG. 11A and FIG. 11B are drawings illustrating a bobbin 320 in the driving device 300 shown in FIG. 7.

In the exercise equipment 1000 according to an embodiment of the present disclosure, the bobbin 320 may include a bobbin body 321 and a bobbin sprocket 323.

The bobbin body 321 is formed along the outer surface of the bobbin shaft 325 to rotate together with the bobbin shaft 325, and the cable part 200 is wound around the same. That is, when the bobbin shaft 325 rotates, the bobbin body 321 rotates in the direction of winding or unwinding the cable part 200 so that the exposed length of the cable part 200 may vary.

The bobbin sprocket 323 is formed along the outer surface at the end of the bobbin shaft 325 to rotate together with the bobbin shaft 325, and another portion of the timing belt 330 is fastened thereto. That is, the rotational force transmitted from the driving motor 310 may rotate the bobbin sprocket 323 through the timing belt 330, and both the bobbin shaft 325 and the bobbin body 321 may rotate when the bobbin sprocket 323 rotates.

As described above, in the exercise equipment 1000 according to an embodiment of the present disclosure, since the bobbin body 321 around which the cable part 200 is wound and the bobbin sprocket 323 to which the timing belt 330 is fastened are formed separately, the stress applied by the cable part 200 and the stress applied by the timing belt 330 are distributed from each other in the bobbin 320, thereby reducing mechanical stress.

In the exercise equipment 1000 according to an embodiment of the present disclosure, the bobbin 320 may further include a bobbin guide 326 that is installed to cover the outer circumferential side of the bobbin body 321 so as to restrict the cable part 200 from being separated from the bobbin body 321.

That is, as shown in FIG. 11B, the bobbin guide 326 may cover the outer circumferential side of the bobbin body 321 around which the cable part 200 is wound.

Accordingly, the cable part 200 may be stably wound between the bobbin body 321 and the bobbin guide 326, and even if a part of the cable part 200 is separated from the bobbin body 321 due to the cable part 200 becoming loose, the contact of the cable part 200 with other components may be minimized.

As described above, in the exercise equipment 1000 according to an embodiment of the present disclosure, since the bobbin guide 326 is installed to cover the outer circumferential side of the bobbin body 321, it is possible to guide the winding or unwinding of the cable part 200 and prevent the cable part 200 from being separated from the bobbin body 321, thereby preventing interference with other adjacent components.

In the exercise equipment 1000 according to an embodiment of the present disclosure, the cable part 200 may be wound according to sequential heights between the bottom and top of the bobbin body 321. Here, the sequential height may be the height from the bottom of the bobbin body 321 to the top, the height from the top of the bobbin body 321 to the bottom, or the height from the center of the bobbin body 321 to the top or bottom.

Specifically, as shown in FIGS. 11A and 11B, the bobbin body 321 is formed to have a cylindrical outer surface, so that the outer surface may form a winding surface on which the cable part 200 is wound.

In this case, since the maximum exposed length of the cable part 200 is proportional to the cylindrical area of the cylindrical winding surface of the bobbin body 321, it may be advantageous to secure the maximum height of the bobbin body 321.

However, considering the characteristics of the exercise equipment 1000, since there is a limit to the size and height of the accommodation space 101 of the body part 100, the cylindrical radius and height of the bobbin body 321 may be selected appropriately maximally using the accommodation space 101.

Therefore, considering the specifications of the bobbin body 321 selected above, in order to secure a longer exposed length of the cable part 200, the cable part 200 needs to be wound according to sequential heights between the bottom and top of the bobbin body 321 such that the wound cable parts 200 do not interfere with each other.

As described above, in the exercise equipment 1000 according to an embodiment of the present disclosure, since the cable part 200 is wound according to the sequential heights between the bottom and top of the bobbin body 321, it is possible to maintain a stable winding state while securing a long length of the cable part 200 wound around the bobbin 320.

In the exercise equipment 1000 according to an embodiment of the present disclosure, the bobbin 320 may further include a bobbin shaft housing 328 and a bobbin shaft bearing 329.

The bobbin shaft housing 328 may allow the bobbin shaft 325 to pass therethrough to restrict movement of the bobbin shaft 325, and may support the bobbin shaft 325 without restricting the axial rotation of the bobbin shaft 325.

To this end, the bobbin shaft housing 328 may be coupled to the body part 100 so as to support the bobbin shaft 325 while restricting movement of the bobbin shaft housing 328.

The bobbin shaft bearing 329 is interposed between the bobbin shaft 325 and the bobbin shaft housing 328 so as to reduce the frictional resistance of the bobbin shaft 325 against the bobbin shaft housing 328.

That is, as shown in FIG. 11B, the bobbin shaft 325 is installed to pass through the bobbin shaft housing 328, and the bobbin shaft bearing 329 may be interposed at a position where the bobbin shaft 325 comes into contact with the bobbin shaft housing 328.

In this case, a plurality of bobbin shaft bearings 329 may be provided with various structures and arrangements capable of reducing the frictional resistance between the bobbin shaft 325 and the bobbin shaft housing 328 when the bobbin shaft 325 rotates.

As described above, in the exercise equipment 1000 according to an embodiment of the present disclosure, since the bobbin shaft 325 is installed through the bobbin shaft housing 328 and the bobbin shaft bearing 329, the bobbin shaft 325 may be installed to be rotatable while being stably supported.

Figure 12:
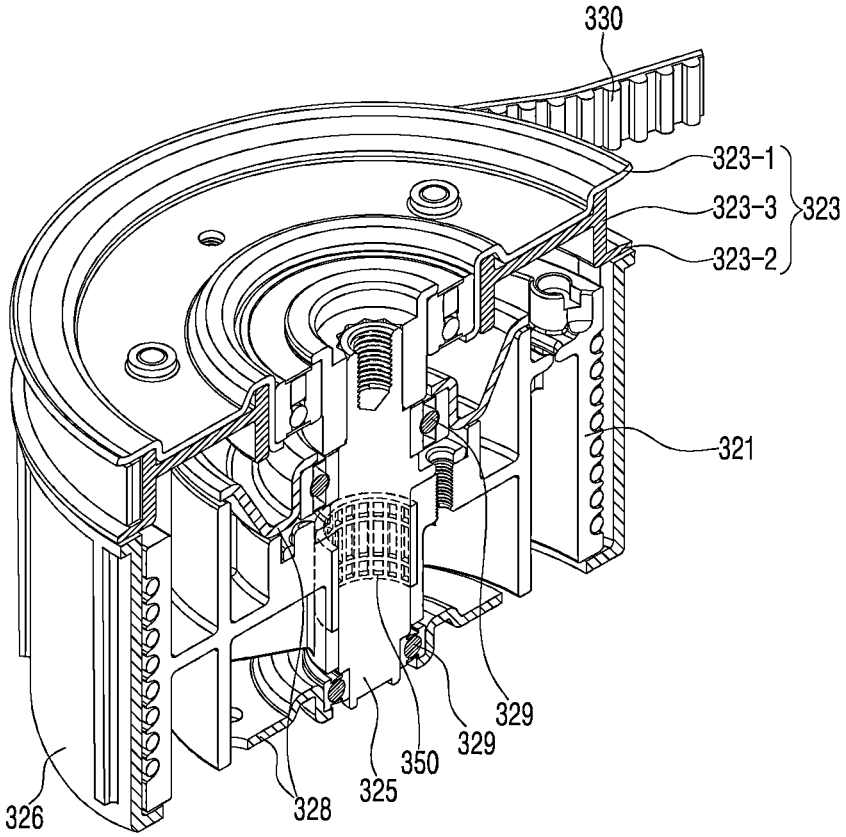
FIG. 12 is a drawing illustrating the state in which the timing belt is fastened to the bobbin sprocket in the driving device shown in FIG. 7.
Figure 13:
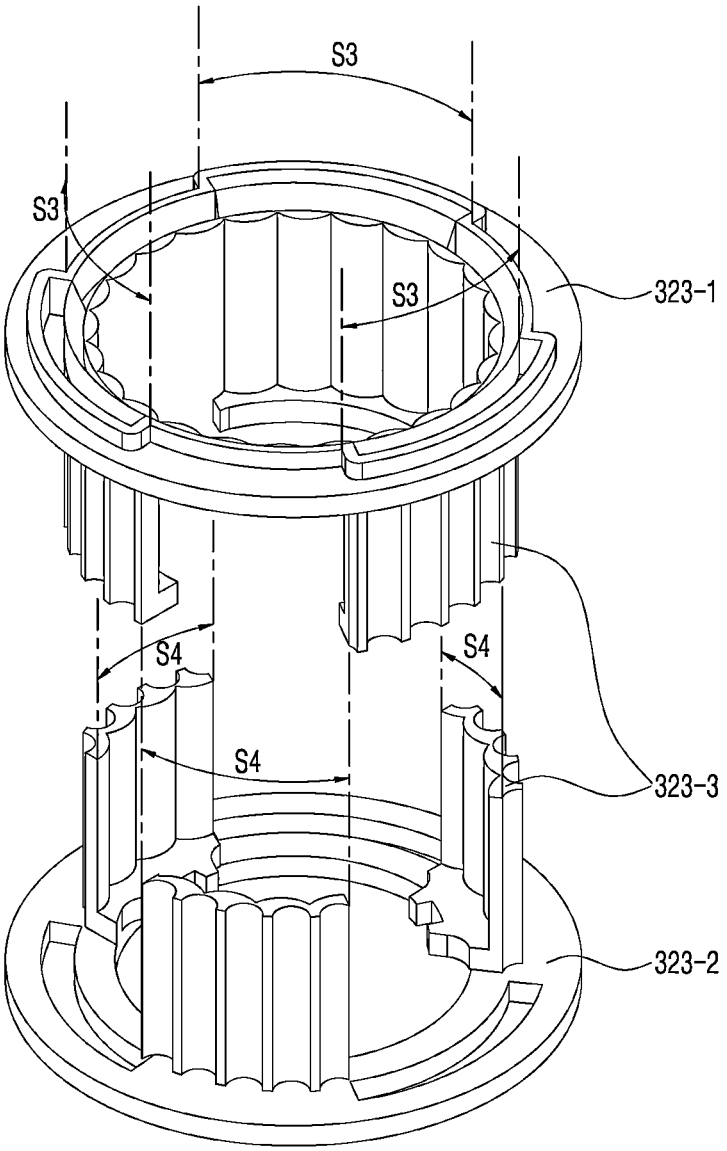
FIG. 13 is a drawing illustrating the structure of the bobbin sprocket in the driving device shown in FIG. 7 in more detail.

FIG. 12 is a drawing illustrating the state in which the timing belt 330 is fastened to the bobbin sprocket 323 in the driving device 300 shown in FIG. 7. FIG. 13 is a drawing illustrating the structure of the bobbin sprocket 323 in the driving device 300 shown in FIG. 7 in more detail.

In the exercise equipment 1000 according to an embodiment of the present disclosure, the bobbin sprocket 323 may include a second tooth body 323-3, a third belt guide 323-1, and a fourth belt guide 323-2.

The second tooth body 323-3 may have an outer surface that is toothed to be engaged with the timing belt 330 and rotate axially by frictional force with the timing belt 330.

In this case, as shown in FIG. 12, the outer surface of the second tooth body 323-3 may be toothed, and the timing belt 330 may also be toothed corresponding to the toothed outer surface, so that rotation force may be transmitted in the state in which the toothed surface of the timing belt 330 and the toothed surface of the second tooth body 323-3 are engaged.

The third belt guide 323-1 is formed to protrude in the circumferential direction from one side of the second tooth body 323-3 in the axial direction of the bobbin shaft 325, and the fourth belt guide 323-2 is formed to protrude in the circumferential direction from the other side of the second tooth body 323-3 in the axial direction of the bobbin shaft 325.

That is, as shown in FIG. 12, the third belt guide 323-1 and the fourth belt guide 323-2 may be formed to protrude both sides of the second tooth body 323-3, respectively, in the axial direction of the bobbin shaft 325.

Accordingly, the timing belt 330 wound around the outer surface of the second tooth body 323-3 may be prevented from being separated from the bobbin shaft 325 in the axial direction.

As described above, in the exercise equipment 1000 according to an embodiment of the present disclosure, since the bobbin sprocket 323 includes the second tooth body 323-3, the third belt guide 323-1, and the fourth belt guide 323-2, it is possible to prevent the timing belt 330 from being separated from the bobbin sprocket 323 when transmitting rotation force through the timing belt 330.

In the exercise equipment 1000 according to an embodiment of the present disclosure, the third belt guide 323-1 may be formed integrally with a portion of the second tooth body 323-3 in the third section S3. In this case, the fourth belt guide 323-2 may be formed integrally with the remaining portion of the second tooth body 323-3 in the fourth section S4 that does not overlap the third section S3.

That is, as illustrated in FIG. 13, the second tooth body 323-3 may be formed to be divided into the third section S3 and the fourth section S4. In addition, the second tooth body 323-3 in the third section S3 may be formed integrally with the third belt guide 323-1, and the second tooth body 323-3 in the fourth section S4 may be formed integrally with the fourth belt guide 323-2.

As described above, if the bobbin sprocket 323 is configured in a structure in which the third belt guide 323-1 and the fourth belt guide 323-2 are formed to protrude from both sides of the second tooth body 323-3, respectively, in the axial direction of the bobbin shaft 325, it may be difficult to integrally injection-mold the bobbin sprocket 323 at once.

That is, if the injection mold is to be configured with an upper mold for forming the upper surface of the bobbin sprocket 323 and a lower mold for forming the lower surface of the bobbin sprocket 323, there may be a problem with undercuts or the like because the third belt guide 323-1 and the fourth belt guide 323-2 vertically overlap each other.

Therefore, it may be a way to increase the efficiency of manufacturing that the third belt guide 323-1 and the fourth belt guide 323-2 are manufactured separately from each other and that the second tooth body 323-3 is divided and integrally formed with the third belt guide 323-1 and the fourth belt guide 323-2, respectively.

As described above, in the exercise equipment 1000 according to an embodiment of the present disclosure, since the second tooth body 323-3 is divided into two portions that are to be integrally formed with the third belt guide 323-1 and the fourth belt guide 323-2, respectively, the bobbin sprocket 323 may be easily manufactured using a mold.

In the exercise equipment 1000 according to an embodiment of the present disclosure, the driving device 300 may further include a one-way clutch 350.

Specifically, the one-way clutch 350 is interposed between the bobbin body 321 and the bobbin shaft 325, between the bobbin shaft 325 and the bobbin sprocket 323, between the rotor sprocket 313 and the motor shaft 315, or between the motor shaft 315 and the rotor 312 to restrict the rotation force in one direction.

As described above, in the case where the driving device 300 provides the cable part 200 with an exercise load against the external force applied to the cable part 200, the cable part 200 may excessively loosen in a moment when the tension on the cable part 200 is released.

That is, if the tension is removed from the cable part 200 in the state in which the external force applied to the cable part 200 and the exercise load provided from the driving device 300 are balanced to a certain extent, the driving device 300 may experience an inertial rotation momentarily, resulting in an unintended excessive loosening phenomenon of the cable part 200.

Therefore, in order to prevent such excessive loosening phenomenon of the cable part 200, it is necessary to provide a predetermined disconnection mechanism on the transmission path of the inertial rotation force.

That is, the excessive loosening phenomenon of the cable part 200 may be prevented by installing a disconnection mechanism such as a one-way clutch 350 on the transmission path of the inertial rotation force, thereby restricting the one-way rotation force due to the inertial rotation.

Here, the disconnection mechanism such as the one-way clutch 350 may be provided at any point between the rotor 312 and the bobbin 320, and as it is provided closer to the bobbin 320, the excessive loosening phenomenon of the cable part 200 may be prevented more effectively.

Accordingly, the disconnection mechanism such as the one-way clutch 350 may be interposed between the bobbin body 321 and the bobbin shaft 325, between the bobbin shaft 325 and the bobbin sprocket 323, between the rotor sprocket 313 and the motor shaft 315, or between the motor shaft 315 and the rotor 312.

As described above, in the exercise equipment 1000 according to an embodiment of the present disclosure, since the one-way clutch 350 is installed on the transmission path of the inertial rotation force, the excessive loosening phenomenon of the cable part 200 due to inertial rotation, which may occur when the tension is removed from the cable part 200, may be effectively prevented.

In the exercise equipment 1000 according to an embodiment of the present disclosure, a plurality of cable parts 200 may be provided in the body part 100, and the driving device 300 may be installed for each cable part 200.

In this regard, the user using the exercise equipment 1000 according to the present embodiment may wish to perform an exercise in more diverse ways for more diverse parts of body.

Accordingly, a plurality of cable parts 200 may be disposed in the body part 100 to enable the user to perform an exercise using both arms at the same time or using arms and legs at the same time. Alternatively, it may be desirable to have a plurality of cable parts 200 disposed in the body part 100 so that several people may use one exercise equipment 1000 at the same time.

Meanwhile, in the case where a plurality of cable parts 200 are provided in the body part 100 as described above, the arrangement of the driving devices 300 coupled to provide an exercise load to the cable parts 200 may be an important consideration.

If a plurality of cable parts 200 are coupled to one driving device 300, it is necessary to install a separate differential or the like so that the exercise load provided from the driving device 300 is distributed to the respective cable parts 200.

However, this structure may generate noise and vibration due to transmission through gears inside the differential, so that the user using the exercise equipment 1000 may have a non-smooth and heterogeneous feeling of pulling the cable parts 200. In addition, this structure may bring about mechanical/signal interference between the driving device 300 and each cable part 200, making it difficult to precisely detect or control the exposed length of each cable part 200.

Therefore, the exercise equipment 1000 according to the present embodiment is structured in such a way that one cable part 200 is coupled to one driving device 300 to minimize noise and vibration and provide an efficient exercise load. In addition, as many driving devices 300 as the cable parts 200 are allocated to minimize mechanical/signal interference with each other, enabling precise detection and control.

In addition, since as many driving devices 300 as the cable parts 200 may be repeatedly provided as the same component, costs may be reduced when manufacturing the exercise equipment 1000.

As described above, in the exercise equipment 1000 according to an embodiment of the present disclosure, since a plurality of cable parts 200 are disposed in the body part 100, and since the driving device 300 for providing an exercise load is installed in each cable part 200, it is possible to precisely sense and control the exposed length of each of the plurality of cable parts 200, and the feeling of pulling the cable may be improved, thereby improving the usability of the device.

The exercise equipment 1000 according to an embodiment of the present disclosure may further include a controller 400 that is disposed in the space formed between the respective driving devices 300 in the accommodation space 101 and controls the driving devices 300.

Specifically, the controller 400 may be connected to respective elements constituting the exercise equipment 1000 so as to control the operation of each element.

For control of the controller 400, the exercise equipment 1000 may be equipped with a storage medium in which an application program is stored. In addition, the controller 400 may be configured to execute an application program according to information input to the exercise equipment 1000 and information output from the exercise equipment 1000, thereby controlling the exercise equipment 1000.

In this case, the controller 400 may perform control such that the respective driving devices 300 that provide the exercise load operate independently. That is, the controller 400 may control the respective driving devices 300 to operate in different states from each other, and may perform control such that the exercise load provided by one driving device 300 is not related to the exercise load provided by another driving device 300.

In this case, although the exercise equipment 1000 may be used in various ways, it may not be effective when the user using the exercise equipment 1000 performs exercises for multiple body parts.

For example, as shown in FIGS. 3 and 4, in the case where the user performs exercise using both arms simultaneously, the user may wish to obtain the exercise effect as if lifting a single barbell, while the exercise loads applied to the respective arms are linked to each other.

However, if the respective driving devices 300 are controlled independently, the user may feel as if he or she is lifting a different barbell with each arm, which may not be the user's intention.

In addition, in the case where the user performs an exercise using both arms at the same time, the arm with strong strength may be distinguished from the arm with weak strength, so it may be desirable to provide exercise loads linked to each other to the respective arms in consideration of the strength of the arms.

Accordingly, the controller 400 may control the driving devices 300 such that the respective driving devices 300 operate in conjunction with each other.

As described above, in the exercise equipment 1000 according to an embodiment of the present disclosure, since the respective driving devices 300 that provide exercise loads to the respective cable parts 200 are controlled in conjunction with each other by the controller 400, the user may efficiently perform strength training, as well as various exercise modes through the device.

In the exercise equipment 1000 according to an embodiment of the present disclosure, a pair of the driving devices 300 may be disposed to be symmetrical on both sides of the first direction D1. Here, referring to FIGS. 5 and 6, a pair of driving devices 300 may be arranged in a point-symmetrical structure with respect to the center point C on the plane of the body part 100.

As described above, in the case where the cable parts 200 are pulled from both end portions of the upper surface 104 of the body part 100, it may be desirable for the exercise load transfer structure that the respective driving devices 300 coupled to the respective cable parts 200 are distributed and disposed on both sides of the body part 100, instead of being concentrated on a specific portion of the body part 100.

In addition, since the body part 100 is required to be stably maintained on the ground when the user uses the exercise equipment 1000, it is desirable that the weight of the exercise equipment 1000 is evenly distributed overall.

In particular, since the driving device 300 has a relatively heavy weight, compared to other components, due to its structural characteristics for providing exercise loads, the driving device 300 needs to be disposed in a balanced manner in the accommodation space 101 of the body part 100, instead of being concentrated on a specific portion.

Therefore, as shown in FIGS. 5 and 6, it may be desirable to arrange a pair of driving devices 300 to be point-symmetrical on both sides of the first direction D1 in the accommodation space 101.

As described above, in the exercise equipment 1000 according to an embodiment of the present disclosure, since a pair of driving devices 300 are disposed to be point-symmetrical on both sides of the body part 100 in the first direction D1, the overall weight of the device may be distributed stably without being lopsided while easily providing exercise loads to the respective cable parts 200.

In the exercise equipment 1000 according to an embodiment of the present disclosure, the controller 400 may be disposed between a pair of driving devices 300.

As described above, in the case where the respective driving devices 300 are distributed and arranged on both sides of the body part 100, it may be desirable for the control signal transmission structure that the controller 400 connected to the respective driving devices 300 is disposed in the central portion of the body part 100 (the portion between the driving devices 300).

In addition, the central portion of the body part 100 (the portion between the driving devices 300) is spatially more spacious in the case where the respective driving devices 300 are distributed and arranged on both sides of the body part 100, so it may be desirable to place various electronic/control/heat dissipation parts, including the controller 400, in the central portion of the body part 100 (the portion between the driving devices 300).

As described above, in the exercise equipment 1000 according to an embodiment of the present disclosure, since the controller 400 is disposed in the space formed between the driving devices 300 in the accommodation space 101, the controller 400 may be effectively connected to the driving devices 300, and space efficiency for the accommodation space 101 may be maximized.

Although specific embodiments of the present disclosure have been described and shown above, the present disclosure is not limited to the described embodiments, and it is obvious to those skilled in the art to which the present disclosure pertains that various modifications and variations may be made without departing from the spirit and scope of the present disclosure. Accordingly, such modifications or variations should not be understood independently from the technical idea or perspective of the present disclosure, and the modified embodiments should be considered to fall within the scope of the claims of the present disclosure.

DESCRIPTION OF REFERENCE NUMERALS

100: Body part 101: Accommodation space
103: Outlet 104: Upper surface of body part
105: Lower surface of body part 200: Cable part
201: One end of cable part 202: The other end of cable part
300: Driving device 310: Driving motor
311: Stator 312: Rotor
313: Rotor sprocket 313-1: First belt guide
313-2: Second belt guide 313-3: First tooth body
315: Motor shaft 316: Encoder magnet
317: Encoder sensor 318: Motor shaft housing
319: Motor shaft bearing 320: Bobbin
321: Bobbin body 323: Bobbin sprocket
323-1: Third belt guide 323-2: Fourth belt guide
323-3: Second tooth body 325: Bobbin shaft
326: Bobbin guide 328: Bobbin shaft housing
329: Bobbin shaft bearing 330: Timing belt
340: Articulation pulley 350: One-way clutch
400: Controller 1000: Exercise equipment
D1: First direction D2: Second direction
S1: First section S2: Second section
S3: Third section S4: Fourth section
C: Center point of plane on body part

INDUSTRIAL APPLICABILITY

According to at least one of the embodiments of the present disclosure, since the driving device is configured in an outer rotor structure in which the rotor is arranged on the outer side of the stator in the circumferential direction, the driving device may be manufactured to be slim even if the driving device has high torque with the driving motor of a larger radius.

In addition, according to at least one of the embodiments of the present disclosure, since the driving device is configured in a structure in which the driving motor and the bobbin are separated and connected through the timing belt according to the rotation ratio in the driving device, it is possible to configure an optimal structure of the driving device in consideration of both the torque/rotation characteristics of the driving motor and the load/pulling speed required for strength exercise.

In addition, according to at least one of the embodiments of the present disclosure, since the driving device is configured in a structure in which the driving motor and the bobbin do not overlap each other on a plane, it is possible to appropriately dispose the driving motor and the bobbin while preventing the overall height of the driving device from increasing.

In addition, according to at least one of the embodiments of the present disclosure, since the motor shaft is installed through the motor shaft housing and the motor shaft bearing, the motor shaft may be installed to be rotatable while being stably supported.

In addition, according to at least one of the embodiments in the present disclosure, since the rotation amount of the driving motor is detected through the encoder magnet and the encoder sensor, the driving motor may be controlled more easily.

In addition, according to at least one of the embodiments of the present disclosure, since the rotor sprocket includes the first tooth body, the first belt guide, and the second belt guide, it is possible to prevent the timing belt from being separated from the rotor sprocket when transmitting rotation force through the timing belt.

In addition, according to at least one of the embodiments of the present disclosure, since the first tooth body is divided into two portions that are to be integrally formed with the first belt guide and the second belt guide, respectively, the rotor sprocket may be easily manufactured using a mold.

In addition, according to at least one of the embodiments of the present disclosure, since the bobbin body around which the cable part is wound and the bobbin sprocket to which the timing belt is fastened are formed separately, the stress applied by the cable part and the stress applied by the timing belt are distributed from each other in the bobbin, thereby reducing mechanical stress.

In addition, according to at least one of the embodiments of the present disclosure, since the bobbin guide is installed to cover the outer circumferential side of the bobbin body, it is possible to guide the winding or unwinding of the cable part and prevent the cable part from being separated from the bobbin body, thereby preventing interference with other adjacent components.

In addition, according to at least one of the embodiments in the present disclosure, since the cable part is wound according to the sequential heights between the bottom and top of the bobbin body, it is possible to maintain a stable winding state while securing a long length of the cable part wound around the bobbin.

In addition, according to at least one of the embodiments of the present disclosure, since the bobbin shaft is installed through the bobbin shaft housing and the bobbin shaft bearing, the bobbin shaft may be installed to be rotatable while being stably supported.

In addition, according to at least one of the embodiments of the present disclosure, since the bobbin sprocket includes the second tooth body, the third belt guide, and the fourth belt guide, it is possible to prevent the timing belt from being separated from the bobbin sprocket when transmitting rotation force through the timing belt In addition, according to at least one of the embodiments of the present disclosure, since the second tooth body is divided into two portions that are to be integrally formed with the third belt guide and the fourth belt guide, respectively, the bobbin sprocket may be easily manufactured using a mold.

In addition, according to at least one of the embodiments of the present disclosure, since a one-way clutch is installed on the transmission path of the inertial rotation force, the excessive loosening phenomenon of the cable part due to inertial rotation, which may occur when the tension is removed from the cable part, may be effectively prevented.

In addition, according to at least one of the embodiments of the present disclosure, since the driving motor used in the driving device is configured in a structure capable of producing rotation force around a longitudinal motor shaft, even if the driving device has high torque with a driving motor of a larger radius, the device may be manufactured to be slim.

In addition, according to at least one of the embodiments of the present disclosure, since the body part is formed to be long in the first direction, and since the cable part is installed to be exposed from the end portion of the body part in the first direction, the user may effectively perform strength exercises using both arms while standing on the body part.

In addition, according to at least one of the embodiments of the present disclosure, since the driving motor is disposed inward from the outlet in the first direction, and since the bobbin is disposed in the second direction intersecting the first direction, the driving motor and the bobbin, which are separately disposed, may be appropriately disposed without overlapping each other on the plane.

In addition, according to at least one of the embodiments of the present disclosure, since the bobbin is lopsidedly disposed from the outlet with respect to the extension line along the first direction so as to maximize the area of the driving motor, it is possible to secure a maximal space for arrangement of the driving motor.

In addition, according to at least one of the embodiments of the present disclosure, since the cable part extending from the biased bobbin in the first direction is bent at the articulation pulley and extends to the outlet, even if the bobbin is lopsidedly disposed, the cable part may extend without interference with other components.

In addition, according to at least one of the embodiments of the present disclosure, since a plurality of cable parts are disposed in the body part, and since the driving device for providing an exercise load is installed in each cable part, it is possible to precisely sense and control the exposed length of each of the plurality of cable parts, and the feeling of pulling the cable may be improved, thereby improving the usability of the device.

The invention claimed is:

1. A driving device that winds a portion of a cable and provides the cable with an exercise load, the driving device comprising:

a stator that is disposed outwards of a motor shaft in a circumferential direction;

a rotor that is positioned apart from the stator in the circumferential direction to be rotated by the stator, and is coupled to the motor shaft to rotate together with the motor shaft;

a rotor sprocket that is provided along an outer surface of the motor shaft and at an end thereof to rotate together with the motor shaft;

a bobbin that is rotatable around a bobbin shaft and is configured to wind a portion of the cable therearound; and a timing belt that connects the rotor sprocket and the bobbin to transmit a rotation force of the rotor sprocket to the bobbin.

2. An exercise equipment comprising:

a body having an accommodation space formed therein, and an upper surface formed in a plate shape, a first end of a cable being received in the accommodation space, and the body including an outlet through which the cable extends such that a second end of the cable is exposed to an outside of the body, an exposed length of the cable varying due to manipulation by a user; and the driving device according to claim 1 and which is disposed in the accommodation space.

3. The exercise equipment of claim 2, wherein the body is formed to be relatively longer in a first direction, and the outlet is formed at an end portion of the body in the first direction.

4. The exercise equipment of claim 3, wherein the rotor is disposed inward from the outlet in the first direction, and wherein the bobbin is disposed in a second direction from the rotor, the second direction intersecting the first direction.

5. The exercise equipment of claim 4, wherein the rotor has a larger area than the bobbin when viewed in plan, and wherein the bobbin is disposed on one side of the body, based on an extension line from the outlet along the first direction.

6. The exercise equipment of claim 5, wherein the driving device further comprises:

an articulation pulley disposed in the end portion and in the first direction from the bobbin; and wherein the cable extends from the bobbin to the articulation pulley along the first direction and is bent at the articulation pulley to extend to the outlet.

7. The exercise equipment of claim 2,
wherein the motor shaft and the bobbin shaft are disposed along a longitudinal direction in the accommodation space.

8. The exercise equipment of claim 2,
wherein the exercise equipment comprises a plurality of the cables, and a plurality of the driving devices that are disposed in the body, and
wherein one of the plurality of driving devices is provided for each of the plurality of cables.

9. The driving device of claim 1,
wherein the bobbin comprises:
a bobbin body that is formed along a outer surface of the bobbin shaft to rotate together with the bobbin shaft and is configured to wind the cable; and
a bobbin sprocket that is formed along the outer surface of and at an end of the bobbin shaft to rotate together with the bobbin shaft, the timing belt being fastened thereto.

10. The driving device of claim 9,
wherein the bobbin sprocket comprises:
a second tooth body having an outer surface that is toothed to be engaged with the timing belt;
a third belt guide that is formed to protrude in the circumferential direction from a first side of the second tooth body in an axial direction of the bobbin shaft; and
a fourth belt guide formed to protrude in the circumferential direction from a second side of the second tooth body in the axial direction of the bobbin shaft.

11. The driving device of claim 10,
wherein the bobbin sprocket comprises a third section, and a fourth section that does not overlap the third section,
wherein the third section includes the third belt guide integrally formed with a portion of the second tooth body, and
wherein the fourth section includes the fourth belt guide integrally formed with a remaining portion of the second tooth body.

12. The driving device of claim 9,
wherein the bobbin further includes a bobbin guide that is positioned to cover at least a portion of an outer circumferential side of the bobbin body so as to restrict the cable from being separated from the bobbin body.

13. The driving device of claim 9,
wherein the bobbin body is configured to wind the cable at sequential heights between a bottom and a top of the bobbin body.

14. The driving device of claim 9,
wherein the bobbin further comprises:
a bobbin shaft housing through which a portion of the bobbin shaft passes and that is configured to restrict a movement of the bobbin shaft; and
a bobbin shaft bearing that is interposed between the bobbin shaft and the bobbin shaft housing to reduce a frictional resistance of the bobbin shaft against the bobbin shaft housing.

15. The driving device of claim 9, further comprising a one-way clutch configured to restrict rotation force in one direction, the one-way clutch being interposed:
between the bobbin body and the bobbin shaft,
between the bobbin shaft and the bobbin sprocket,
between the rotor sprocket and the motor shaft, or
between the motor shaft and the rotor.

16. The driving device of claim 1,
wherein the rotor sprocket comprises:
a first tooth body having an outer surface that is toothed to be engaged with the timing belt;
a first belt guide that protrudes in the circumferential direction from a first side of the first tooth body in an axial direction of the motor shaft; and
a second belt guide that protrudes in the circumferential direction from a second side of the first tooth body in the axial direction of the motor shaft.

17. The driving device of claim 16,
wherein the rotor sprocket comprises a first section, and a second section that does not overlap the first section,
wherein first section includes the first belt guide integrally formed with a portion of the first tooth body, and
wherein the second section includes the second belt guide integrally formed with a remaining portion of the first tooth body.

18. The driving device of claim 1,
wherein the bobbin shaft is disposed parallel to the motor shaft and outwards of the rotor in the circumferential direction.

19. The driving device of claim 1, further comprising:
a motor shaft housing through which a portion of the motor shaft passes and that is configured to restrict a movement of the motor shaft; and
a motor shaft bearing that is interposed between the motor shaft and the motor shaft housing to reduce a frictional resistance of the motor shaft against the motor shaft housing.

20. The driving device of claim 1, further comprising:
an encoder magnet that is coupled to the motor shaft to rotate together with the motor shaft; and
an encoder sensor that is disposed apart from the motor shaft to detect a rotation of the encoder magnet.

* * * * *